US010597989B2

(12) United States Patent
Vasques

(10) Patent No.: US 10,597,989 B2
(45) Date of Patent: Mar. 24, 2020

(54) DOWNHOLE SYSTEM FOR UNLOADING LIQUID

(71) Applicant: Welltec Oilfield Solutions AG, Zug (CH)

(72) Inventor: Ricardo Reves Vasques, Allerød (DK)

(73) Assignee: Welltec Oilfield Solutions AG, Zug (CH)

( * ) Notice: Subject to any disclaimer, the term of this patent is extended or adjusted under 35 U.S.C. 154(b) by 152 days.

(21) Appl. No.: 15/194,955

(22) Filed: Jun. 28, 2016

(65) Prior Publication Data

US 2016/0376880 A1 Dec. 29, 2016

(30) Foreign Application Priority Data

Jun. 29, 2015 (EP) ..... 15174401
Jul. 6, 2015 (EP) ..... 15175551

(51) Int. Cl.
*E21B 43/12* (2006.01)
*E21B 34/08* (2006.01)
(Continued)

(52) U.S. Cl.
CPC ..... *E21B 43/123* (2013.01); *E21B 34/08* (2013.01); *E21B 34/14* (2013.01); *E21B 43/121* (2013.01);
(Continued)

(58) Field of Classification Search
CPC ..... E21B 34/14; E21B 43/121; E21B 43/122; E21B 2034/007
See application file for complete search history.

(56) References Cited

U.S. PATENT DOCUMENTS 2,917,004 A 12/1959 Davis et al.
3,606,584 A * 9/1971 Sizer ..... E21B 23/02 166/313
(Continued)

FOREIGN PATENT DOCUMENTS

CA 2 829 630 4/2015
CA 2829630 A1 * 4/2015 ..... E21B 43/122

OTHER PUBLICATIONS

Extended Search Report for EP15175551.9 dated Dec. 23, 2015, 7 pages.

*Primary Examiner* — Robert E Fuller
*Assistant Examiner* — Lamia Quaim
(74) *Attorney, Agent, or Firm* — Nixon & Vanderhye P.C.

(57) ABSTRACT

The present invention relates to a downhole system for unloading a liquid of a well in an annulus between an intermediate casing and a production tubular metal structure. The downhole system comprises the intermediate casing; a pump at a top of the well, configured to pressurise the annulus to displace the liquid in the annulus; the production tubular metal structure having a first inner diameter, arranged partly in the intermediate casing, thereby defining the annulus; a production packer arranged between the intermediate casing and the production tubular metal structure, and a first liquid unloading assembly and a second liquid unloading assembly, each comprising a tubular part having a wall having a second inner diameter, an outer face and an aperture, the tubular part being configured to be mounted as part of the production tubular metal structure; and a check valve connected with the outer face, the check valve having an inlet in fluid communication with the annulus and an outlet in fluid communication with the aperture. The downhole system further comprises a sliding
(Continued)

sleeve arranged to slide along an inner face of the tubular part between an open position and closed position to open or close the aperture. Furthermore, the present invention relates to a liquid unloading method for unloading liquid of a well in an annulus between an intermediate casing and a production tubular metal structure.

17 Claims, 8 Drawing Sheets

(51) Int. Cl.
*E21B 34/14* (2006.01)
*E21B 34/00* (2006.01)

(52) U.S. Cl.
CPC ..... *E21B 43/122* (2013.01); *E21B 2034/002* (2013.01); *E21B 2034/007* (2013.01)

(56) References Cited

U.S. PATENT DOCUMENTS 3,680,637 A * 8/1972 Raulins ..... E21B 23/08 166/313
5,533,572 A * 7/1996 Brady ..... E21B 43/122 166/250.05
5,979,553 A * 11/1999 Brink ..... E21B 43/123 137/155
2006/0076140 A1* 4/2006 Rouen ..... E21B 33/122 166/312
2008/0164033 A1 7/2008 Brink
2009/0084553 A1* 4/2009 Rytlewski ..... E21B 34/06 166/305.1
2010/0032153 A1* 2/2010 Phloi-montri ..... E21B 43/122 166/142
2010/0294506 A1 11/2010 Rodriguez et al.
2014/0076542 A1* 3/2014 Whitsitt ..... E21B 34/14 166/250.1
2014/0318770 A1 10/2014 Hallundbäk et al.
2015/0260038 A1* 9/2015 AlGouhi ..... E21B 49/083 166/264

* cited by examiner

DOWNHOLE SYSTEM FOR UNLOADING LIQUID

This application claims priority to EP Patent Application No. 15174401.8 filed 29 Jun. 2015 and EP Patent Application No. 15175551.9 filed 6 Jul. 2015, the entire contents of each of which are hereby incorporated by reference.

FIELD OF THE INVENTION

The present invention relates to a downhole system for unloading a liquid of a well in an annulus between an intermediate casing and a production tubular metal structure. Furthermore, the present invention relates to a liquid unloading method for unloading liquid of a well in an annulus between an intermediate casing and a production tubular metal structure.

BACKGROUND ART

During completion of a well, the well is filled with liquid, e.g. brine, in the annulus between the intermediate casing and the production casing, which must be unloaded before production can begin. For this purpose, a pump at a top of the well pressurises the annulus with gas from the top to displace the liquid in the annulus through gas lift valves.

Known conventional gas lift valves (GLV) are designed in such a way that the GLV nearest the top opens at one pressure and the next at another pressure. The first GLV then closes at a registered pressure drop. Each GLV is thus designed to be self-operating and is designed from the dimensions of the intermediate casing, the production casing and the pressure available at the top. If the GLVs are not designed correctly, the liquid un-loading procedure fails, e.g. if one GLV does not open or another does not close in a certain order. The GLVs are often designed to close dependent on a pressure drop, which may fail if the GLV does not detect the pressure drop. The failing GLV can then be replaced from within the production casing by intervening the well with a kick-over tool, but the valve needs to be set in either an open or a closed position, depending on the situation, in order for the unloading procedure to be re-established. If the GLV is not in the right position, the unloading procedure cannot be initiated.

SUMMARY OF THE INVENTION

It is an object of the present invention to wholly or partly overcome the above disadvantages and drawbacks of the prior art. More specifically, it is an object to provide an improved liquid-unloading system which does not fail and/or is more cost efficient.

The above objects, together with numerous other objects, advantages and features, which will become evident from the below description, are accomplished by a solution in accordance with the present invention by a downhole system for unloading a liquid of a well in an annulus between an intermediate casing and a production tubular metal structure, comprising:

- the intermediate casing,
- a pump at a top of the well, configured to pressurise the annulus to displace the liquid in the annulus,
- the production tubular metal structure having a first inner diameter, arranged partly in the intermediate casing, thereby defining the annulus,
- a production packer arranged between the intermediate casing and the production tubular metal structure, and

- a first liquid unloading assembly and a second liquid unloading assembly, each comprising:
  - a tubular part having a wall having a second inner diameter, an outer face and an aperture, the tubular part being configured to be mounted as part of the production tubular metal structure, and
  - a check valve connected with the outer face, the check valve having an inlet in fluid communication with the annulus and an outlet in fluid communication with the aperture, wherein the downhole system further comprises a sliding sleeve arranged to slide along an inner face of the tubular part between an open position and closed position to open or close the aperture.

By having a sliding sleeve arranged opposite the liquid unloading assemblies, the gas lift is no longer dependent on timing a certain pressure for opening and closing in a certain sequence, but rather, the sliding sleeve is only opened when gas lift and unloading of liquid are required and closed when this is no longer necessary.

Each liquid unloading assembly may comprise a plurality of check valves.

Furthermore, the second inner diameter may be larger than the first inner diameter, which may form a recess in which the sliding sleeve slides.

Also, a sliding sleeve may be arranged opposite each of the first and second liquid unloading assemblies for opening or closing fluid communication to the first and second liquid unloading assemblies.

The downhole system may further comprise a downhole tool for operating the sliding sleeve between the open and the closed position of the sliding sleeve.

Additionally, each liquid unloading assembly may have an outer diameter which is less than 20% larger than the outer diameter of the production tubular metal structure.

Moreover, each liquid unloading assembly may comprise a plurality of assembly inlets, each assembly inlet being fluidly connected with the inlet of one of the check valves.

Also, the first inner diameter of the production tubular metal structure may be substantially equal to the second inner diameter of the tubular part of the liquid unloading assembly.

In addition, the sliding sleeve may be arranged in a recess of the tubular part.

Further, the sliding sleeve may have a third inner diameter which is substantially equal to the first inner diameter of the production tubular metal structure.

In an embodiment, the downhole system may further comprise a liner hanger casing and a second production packer, the liner hanger casing being arranged between the first production packer and the second production packer, which second production packer may be arranged between the liner hanger casing and the production tubular metal structure.

Additionally, at least some of the check valve assemblies may be arranged below the first production packer.

Also, the tool may comprise a detection unit configured to detect the presence of gas in the production tubular metal structure.

Furthermore, the tool may comprise a driving unit, such as a downhole tractor.

The present invention furthermore relates to a liquid unloading method for unloading liquid of a well in an annulus between an intermediate casing and a production tubular metal structure, comprising:

pressurising the annulus with gas to displace the liquid from the top of the well in through the check valves in the downhole system described above, letting gas through the first check valve into the production tubular metal structure, detecting gas in the production tubular metal structure, closing the first check valve by means of the tool, displacing the liquid by letting the liquid in through the second check valve, letting gas through the second check valve into the production tubular metal structure, and detecting a gas in the production tubular metal structure.

In an embodiment, the detecting a gas may be performed at the top of the well or by means of the tool.

Furthermore, the liquid unloading method may further comprise closing the second check valve.

Finally, the liquid unloading method may further comprise producing hydrocarbon-containing fluid.

BRIEF DESCRIPTION OF THE DRAWINGS

The invention and its many advantages will be described in more detail below with reference to the accompanying schematic drawings, which for the purpose of illustration show some non-limiting embodiments and in which.

All the figures are highly schematic and not necessarily to scale, and they show only those parts which are necessary in order to elucidate the invention, other parts being omitted or merely suggested.

DETAILED DESCRIPTION OF THE INVENTION

Figure 1:
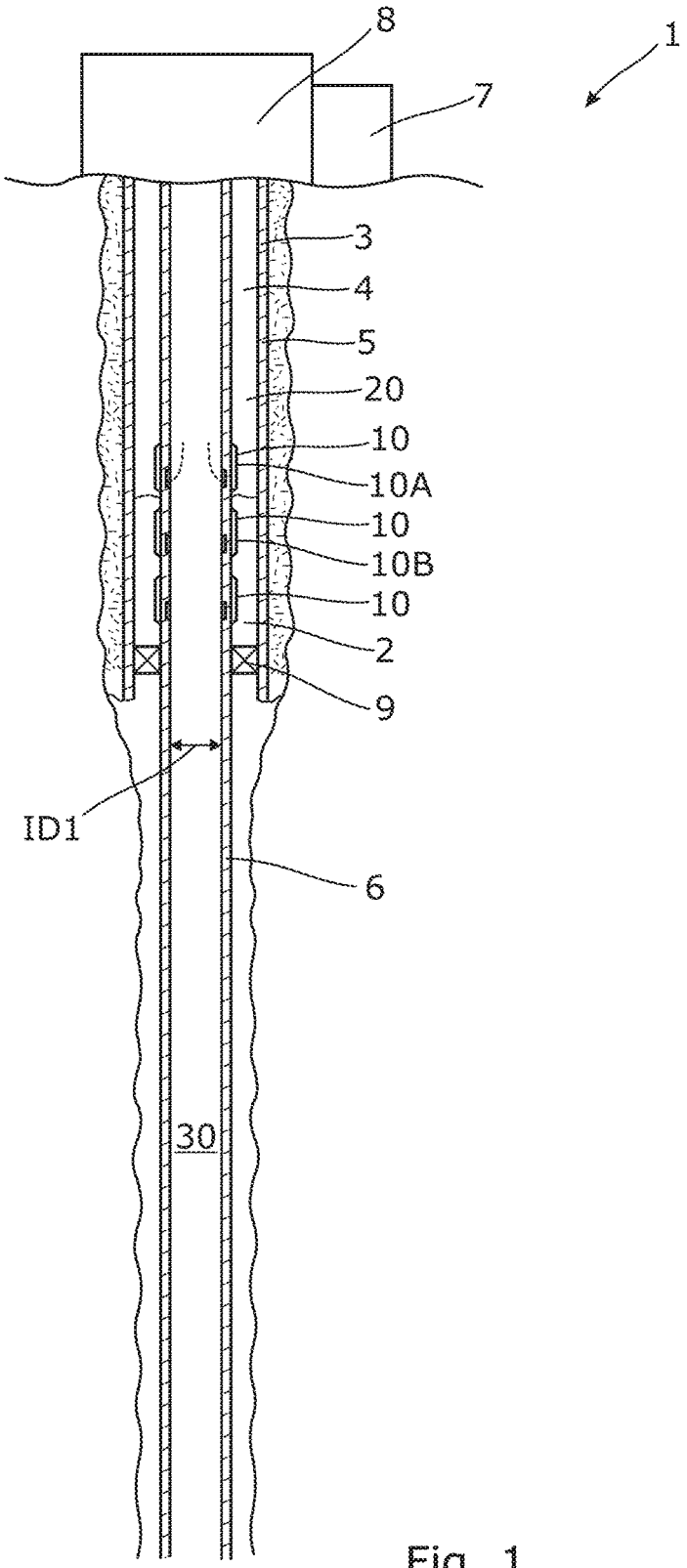
FIG. 1 shows a cross-sectional view of a downhole system.

FIG. 1 shows a downhole system 1 for unloading a liquid 2 of a well 3 in an annulus 4 being an annular space between an intermediate casing 5 and a production tubular metal structure 6. The production tubular metal structure 6 has a first inner diameter ID1 which is not substantially decreased from top to bottom, and the production tubular metal structure is partly arranged in the intermediate casing 5, thereby defining the annulus, and extends below the intermediate casing. A production packer 9, also called a main packer, is arranged between the intermediate casing 5 and the production tubular metal structure 6 to enclose part of the annulus 4. During completion of a well, the well 3 is filled with liquid in the annulus 4, and the liquid must be unloaded before production can begin. For this purpose, the downhole system 1 comprises a pump 7 at a top 8 of the well 3, configured to pressurise the annulus 4 with gas 20 from the top to displace the liquid in the annulus through a first liquid unloading assembly 10A, 10 and a second liquid unloading assembly 10B, 10. The first liquid unloading assembly is arranged closer to the top 8 than the second liquid unloading assembly so that the gas enters the first liquid unloading assembly first and then flows into an inside 30 of the production tubular metal structure 6.

Figure 2:
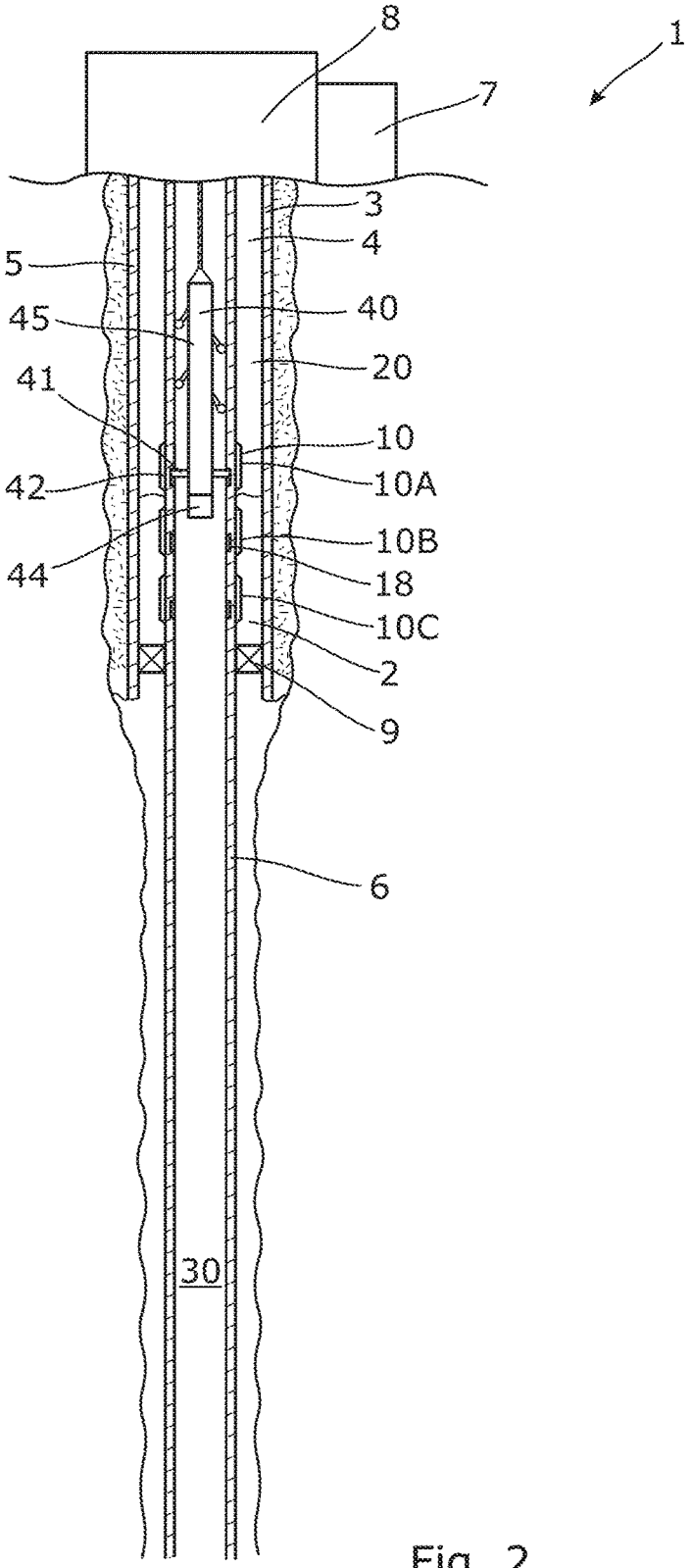
FIG. 2 shows a cross-sectional view of another downhole system.

When gas is detected on the inside 30 of the production tubular metal structure 6, the first liquid unloading assembly 10A is closed by means of a tool 40, as shown in FIG. 2, so that the gas is forced to displace the liquid vertically in the annulus below the first liquid unloading assembly and then enter the second liquid unloading assembly. The tool 40 comprises engagement means 41, such as keys, for engaging a profile 42 in a sliding sleeve 18 of the liquid unloading assembly 10.

Figure 3:
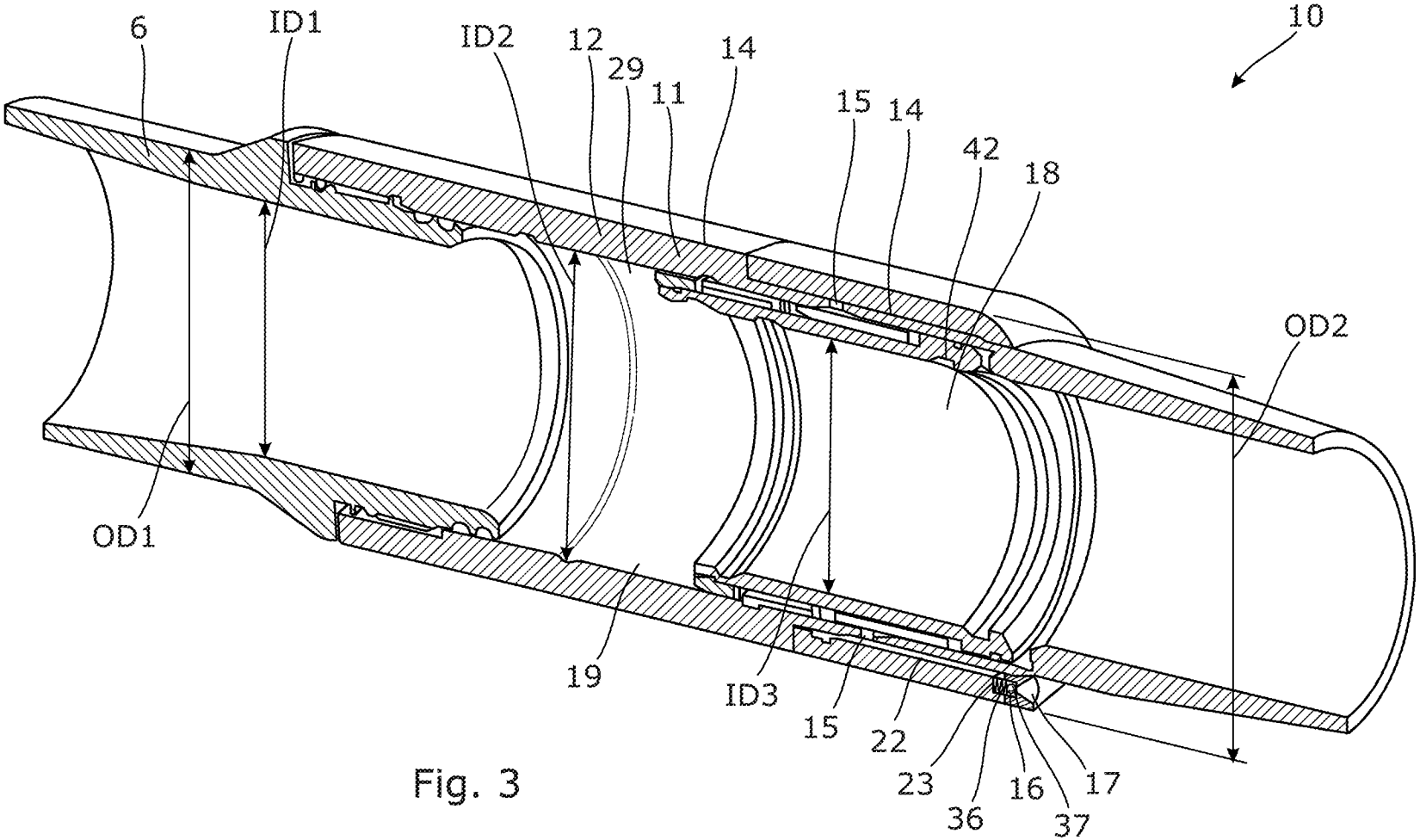
FIG. 3 shows a cross-sectional view of a liquid-unloading assembly mounted as part of the production tubular metal structure.

As shown in FIG. 3, each liquid unloading assembly 10 comprises a tubular part 11 having a wall 12 and a check valve 16 connected with an outer face 14 of the wall. The tubular part 11 is mounted as part of the production tubular metal structure 6, and the wall of the tubular part 11 has a second inner diameter ID2 which is at least equal to the first inner diameter ID1 of the production tubular metal structure 6. The wall 12 has an aperture 15, and the check valve 16 has an outlet 17 in fluid communication with the aperture through a fluid channel 22. Each liquid unloading assembly 10 comprises a sliding sleeve 18 arranged to slide along an inner face 19 of the tubular part 11 between an open position and a closed position to open or close the aperture 15. Due to the fact that the sliding sleeve 18 slides in the recess, the liquid unloading assembly 10 has almost the same inner diameter as the production tubular metal structure 6. Thus, the sliding sleeve 18 has a third inner diameter ID3 which is substantially equal to the first inner diameter ID1 of the production tubular metal structure 6.

Figure 4:
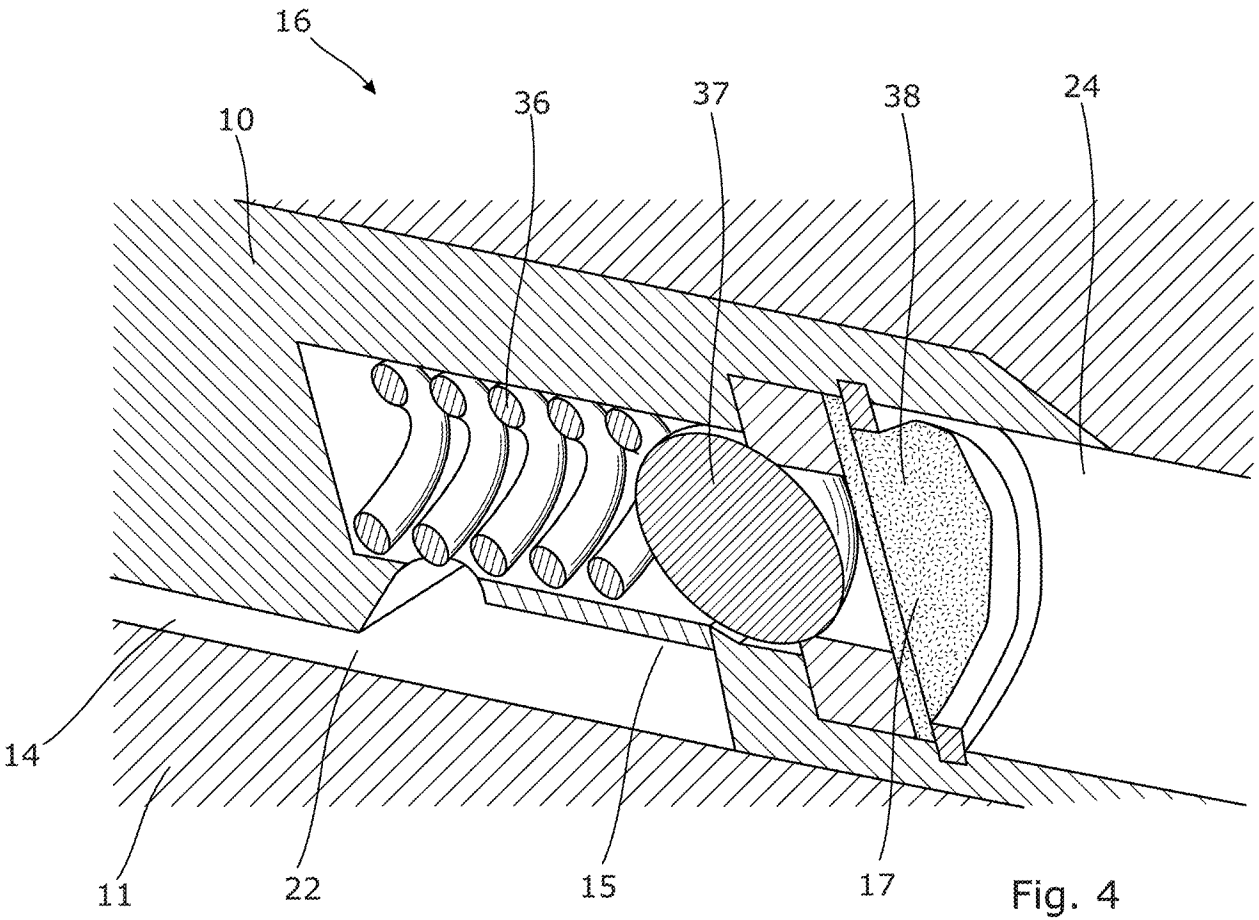
FIG. 4 shows a cross-sectional view of a check valve of the liquid-unloading assembly.

The check valve 16 has an inlet 17 in fluid communication with the annulus 4 (shown in FIG. 6) for letting gas into the inside of the production tubular metal structure 6. The check valve 16 has an outlet 23 in fluid communication with the aperture 15 of the tubular part 11. The check valve 16 comprises a spring element 36 which is compressible when a ball 37 is moved in the axial extension of the liquid unloading assembly 10 by gas entering through the inlet 17. A filtering element 38, shown in FIG. 4, is arranged in the inlet to prevent particles in the gas from entering through the check valve 16. Thus, the check valve 16 is a conventional non-return valve or one-way valve allowing fluid (liquid or gas) to flow through it in only one direction from the annulus to the inside of the production tubular metal structure 6.

By having a simple conventional check valve instead of a larger and more complicated gas lift valve, the liquid-unloading procedure is very simple and does not rely on the gas lift valve to be open and close at certain predetermined pressures. The known conventional gas lift valves (GLVs) are designed so that one GLV opens at one pressure and the next at another pressure. Each GLV is thus designed to be self-operating and designed from the dimensions of the intermediate casing, the production casing and the pressure available at the top. If the GLVs are not designed correctly, the liquid un-loading procedure fails, e.g. if one GLV does not open or another does not close in a certain order. The GLVs are often designed to close dependent on a pressure drop, which may fail. The failing GLV can then be replaced from within the production casing and the unloading procedure re-established. By having a downhole system of the present invention having small, simple check valves and a sliding sleeve operated by a tool for opening and closing the valve assembly, the system has a much simpler design which is less expensive, and the risk of failure is also substantially reduced.

As shown in FIG. 3, the open and closed positions of the check valve 16 are controlled by the tool sliding a sliding sleeve 18 to uncover the aperture 15 of the tubular part 11 and thus allow gas to flow into the production tubular metal structure 6. In FIG. 3, the sliding sleeve 18 is shown in its closed position, covering the aperture 15 and thus preventing gas from flowing into the production tubular metal structure 6 through that check valve 16. The function of the check valve 16 is only to let fluid into the production tubular metal structure 6 and prevent fluid from the inside of the production tubular metal structure from flowing into the annulus. The check valve 16 can thus have a simple design, and every check valve positioned along the production tubular metal structure 6 can have the same simple design with the risk of not matching the dimensions of the well to open and close dependent on pressure and/or pressure difference. The check valve 16 can be arranged outside the production tubular metal structure 6 and therefore does not limit the inner diameter of the production tubular metal structure or increase the outer diameter of the production tubular metal structure.

Figure 5:
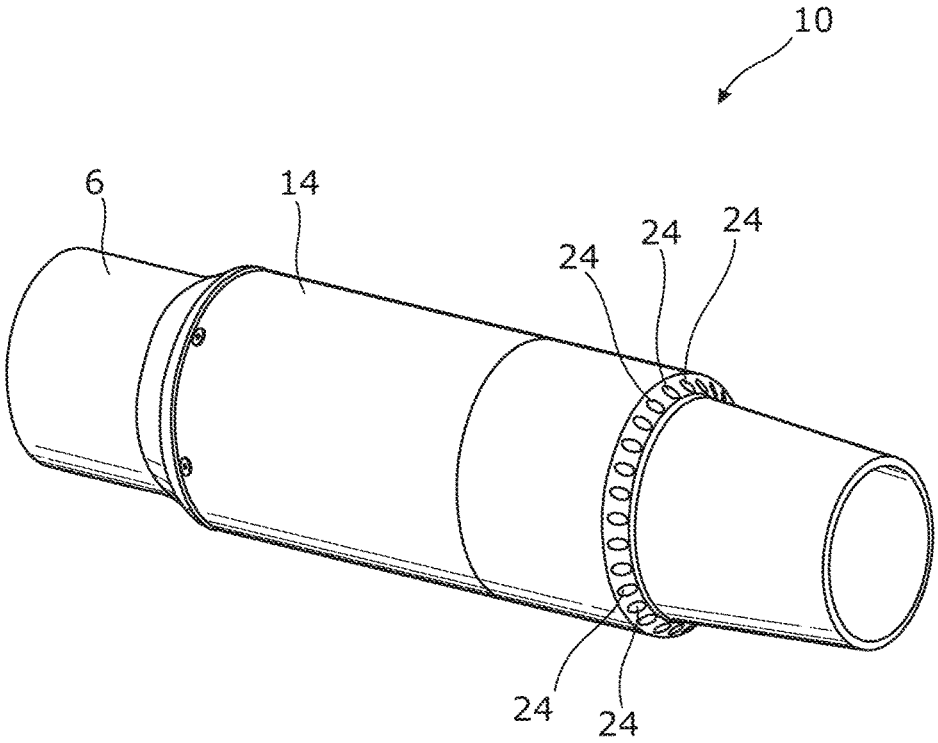
FIG. 5 shows the liquid-unloading assembly in perspective.

In FIG. 5, the liquid unloading assembly 10 comprises a plurality of assembly inlets 24, and each liquid unloading assembly comprises a plurality of check valves so that each assembly inlet 24 is fluidly connected with an inlet of one of the check valves. The liquid unloading assembly 10 may have two assembly inlets 24 fluidly connected with one check valve.

Figure 6:
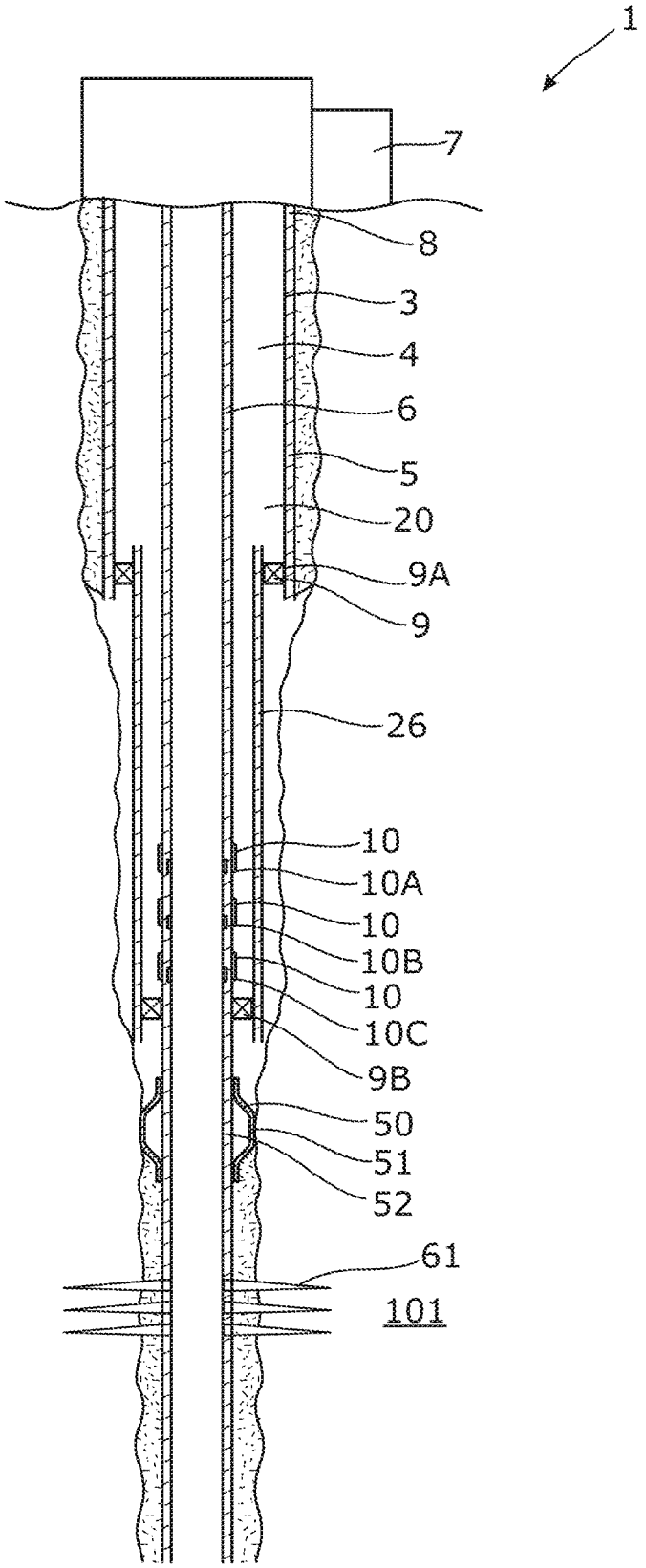
FIG. 6 shows a cross-sectional view of another downhole system.
Figure 7:
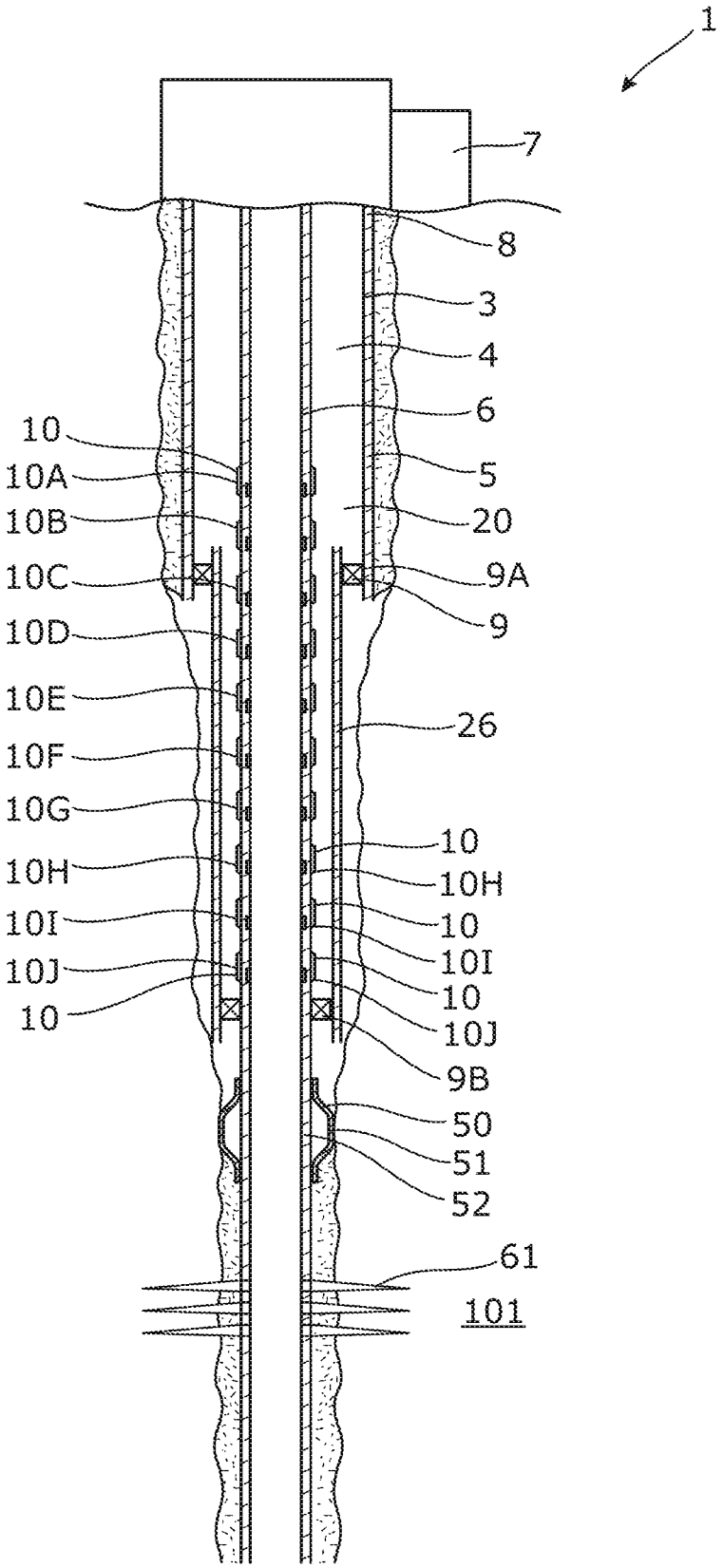
FIG. 7 shows a cross-sectional view of yet another downhole system.

As shown in FIG. 3, each liquid unloading assembly 10 has an outer diameter OD2 which is less than 20% larger than the outer diameter OD1 of the production tubular metal structure 6. In FIG. 6, the downhole system 1 further comprises a liner hanger casing 26 and a second production packer 9B. The liner hanger casing 26 is arranged between the first production packer 9A and the second production packer 9B. The second production packer 9B is arranged between the liner hanger casing 26 and the production tubular metal structure 6. Thus, the annulus 4 is defined by the production tubular metal structure 6, the intermediate casing 5, the liner hanger casing 26 and the first and second production packers 9, 9A, 9B. Due to the fact that each liquid unloading assembly 10 has an outer diameter OD2 (shown in FIG. 3) which is less than 20% larger than the outer diameter OD1 (shown in FIG. 3) of the production tubular metal structure 6, the liquid unloading assembly 10 can be arranged substantially further down the well 3 opposite the liner hanger casing without increasing the outer diameter of the intermediate casing 5. When using conventional gas lift valves for unloading liquid, the gas lift valves increase the outer diameter of the production casing by at least 50%, and therefore, the gas lift valves cannot be arranged as deep in the well as the check valves of FIG. 6. Thus, by using conventional gas lift valves, the liquid unloading is not as efficient as the downhole system of the present invention, and since the liquid un-loading assemblies can be arranged deeper in the well, the liquid-unloading has a much high success rate. Furthermore, when subsequently using the check valves for gas lifting, check valves positioned much further down the well provide gas lift deeper in the well, thereby lifting a higher/longer liquid column and thus providing a more efficient gas lift if needed. Thus, as shown in FIG. 7, some of the check valve assemblies 10 are arranged below the first production packer 9A but are still in fluid communication with the A-annulus, and some of the check valves are arranged above the first production packer. In FIG. 7, the downhole system comprises ten check valve assemblies 10, 10A-10J. The first check valve assembly 10A is arranged closest to the top of the well, and the next check valve assembly 10 is the second check valve assembly 10B, and so on all the way down to the tenth check valve assembly 103 through which the gas flows when the gas has entered all nine of the check valve assemblies 10A-10I arranged above. Each check valve assembly 10A-J is closed by the tool in succession of each other, and the first check valve assembly 10A is closed first, the second check valve assembly 10B closed secondly, and so forth.

One way of detecting gas entering the first check valve may be to detect if the fluid flowing out of the well at the top of the well contains gas. Another way is to detect if the downhole tool 40 comprises a detection unit 44 which is configured to detect the presence of gas in the production tubular metal structure 6, as shown in FIG. 2. The detection unit 44 may comprise an ultrasonic or acoustic sensor, a capacitance sensor or a similar sensor for detecting a change in the flow and the fluid content. The downhole tool may also comprise a driving unit 45, such as a downhole tractor.

First, the annulus 4 is pressurised with gas to displace the liquid from the top of the well 3 in through the first check valve arranged outside the wall of the tubular part and the production tubular metal structure 6. Once gas has been detected in the production tubular metal structure 6, e.g. by the tool or at the top of the well, the first check valve is closed by means of the tool to force the gas further down the well, thereby displacing liquid towards the second check valve and in through the second check valve. If the first check valve stayed open, the liquid displacement would not be as efficient or could completely stop. As the gas displaces the liquid, the gas is aligned with the second check valve and is let through the second check valve into the production tubular metal structure 6. Subsequently, when gas is detected in the production tubular metal structure 6, e.g. from the top of the well or by the tool, the gas has reached the level of the second check valve, and then, this second check valve is closed so that the gas further displaces the liquid downwards in through the next check valve deeper in the well 3. The procedure is continued until almost all the liquid has been displaced and the annulus 4 has been sufficiently emptied of liquid. Then, the production of hydrocarbon-containing fluid through openings/perforations 61 in the production tubular metal structure 6 opposite at the production zone 101 is initiated, as shown in FIG. 6. As can be seen, the production tubular metal structure 6 may also comprise an annular barrier 50 having a tubular metal part mounted as part of the production tubular metal structure. The annular barrier 50 comprises an expandable sleeve 51 expanded by letting pressurised fluid in through an expansion opening 52.

Figure 8:
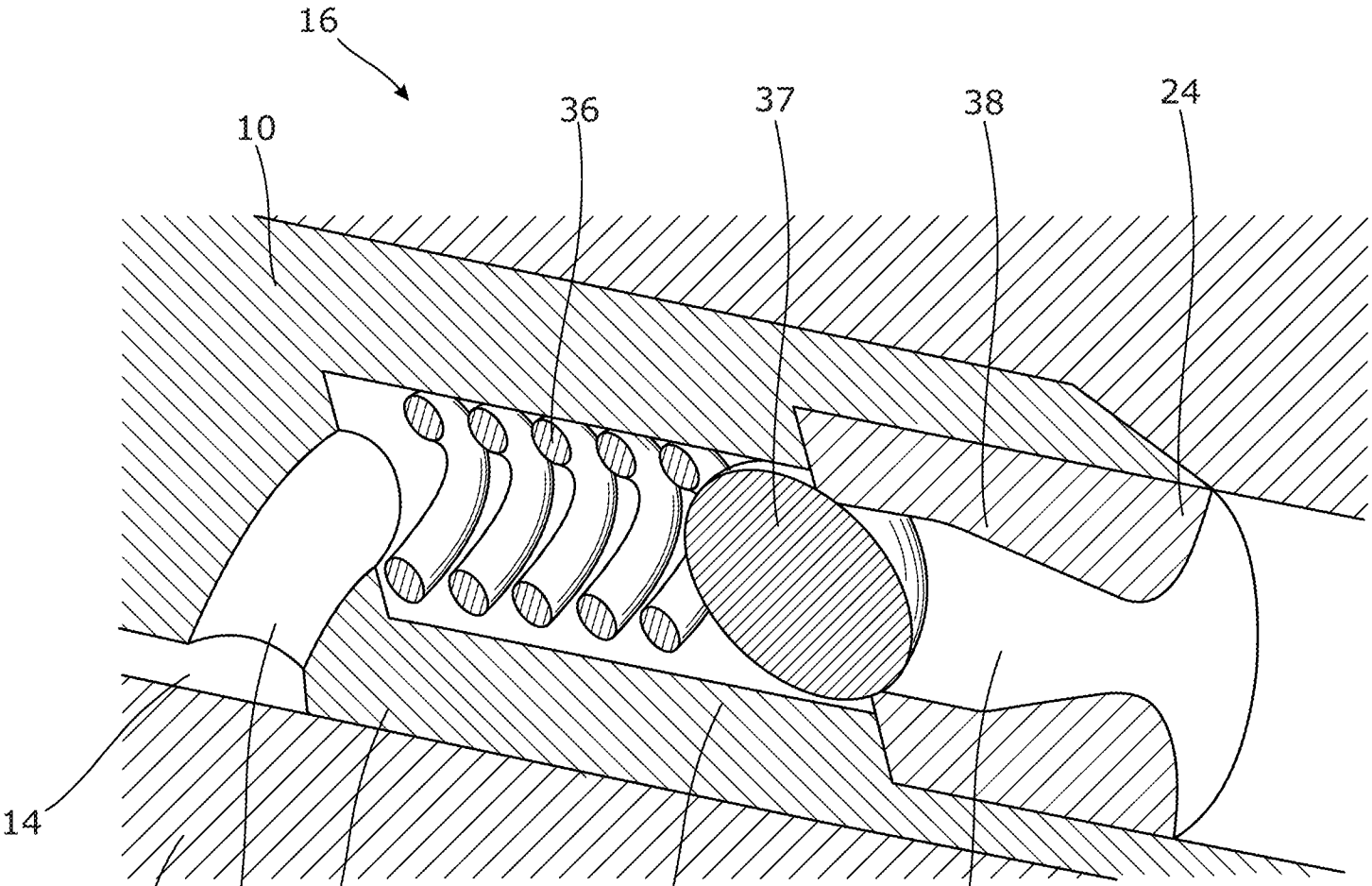
FIG. 8 shows a cross-sectional view of a check valve according yet another liquid unloading assembly.

In FIG. 8, the check valve 16 has an outlet formed as a venturi tube so as to be able to control the outlet pressure better and be more independent of the inlet pressure. The inlet 23 is arranged opposite the inlet 17 and opposite the ball 37.

By fluid or well fluid is meant any kind of fluid that may be present in oil or gas wells downhole, such as natural gas, oil, oil mud, crude oil, water, etc. By gas is meant any kind of gas composition present in a well, completion, or open hole, and by oil is meant any kind of oil composition, such as crude oil, an oil-containing fluid, etc. Gas, oil, and water fluids may thus all comprise other elements or substances than gas, oil, and/or water, respectively.

By a casing, production tubular metal structure, production casing, intermediate casing, or liner hanger casing is meant any kind of pipe, tubing, tubular, liner, string etc. used downhole in relation to oil or natural gas production.

In the event that the tool is not submergible all the way into the casing, a downhole tractor 45 can be used to push the tool all the way into position in the well, as shown in FIG. 2. The downhole tractor may have projectable arms having wheels, wherein the wheels contact the inner surface of the casing for propelling the tractor and the tool forward in the casing. A downhole tractor is any kind of driving tool capable of pushing or pulling tools in a well downhole, such as a Well Tractor®.

Although the invention has been described in the above in connection with preferred embodiments of the invention, it will be evident for a person skilled in the art that several modifications are conceivable without departing from the invention as defined by the following claims.

The invention claimed is:

1. A downhole system for unloading a liquid of a well having an annulus between an intermediate casing and a production tubular metal structure, comprising:

the intermediate casing, a pump at a top of the well, configured to pressurise the annulus to displace the liquid in the annulus, the production tubular metal structure having a first inner diameter, arranged partly in the intermediate casing, thereby defining the annulus, a production packer arranged between the intermediate casing and the production tubular metal structure, and a first liquid unloading assembly and a second liquid unloading assembly, each comprising:

a tubular part having a wall having a second inner diameter, an outer face and an aperture, the tubular part being configured to be mounted as part of the production tubular metal structure, and a check valve connected with the outer face, the check valve having an inlet in fluid communication with the annulus and an outlet in fluid communication with the aperture, wherein the downhole system further comprises a sliding sleeve positioned radially inward relative to each said check valve so that the sliding sleeve and the check valve are positioned on radially opposite sides of the wall, each sliding sleeve being arranged to slide along an inner face of the tubular part between an open position and a closed position to open or close the respective aperture, each said sliding sleeve including a groove on its inner surface and adapted to be engaged by a downhole tool that slides the sliding sleeve between the open and closed positions.

2. A downhole system according to claim 1, wherein each liquid unloading assembly comprises a plurality of check valves.

3. A downhole system according to claim 1, wherein the second inner diameter is larger than the first inner diameter, which forms a recess in which the sliding sleeve slides.

4. A downhole system according to claim 1, wherein a sliding sleeve is arranged opposite each of the first and second liquid unloading assemblies for opening or closing fluid communication to the first and second liquid unloading assemblies.

5. A downhole system according to claim 1, further comprising the downhole tool.

6. A downhole system according to claim 1, wherein each liquid unloading assembly has an outer diameter which is larger than but less than 20% larger than the outer diameter of the production tubular metal structure.

7. A downhole system according to claim 2, wherein each liquid unloading assembly comprises a plurality of assembly inlets, each assembly inlet being fluidly connected with the inlet of one of the check valves.

8. A downhole system according to claim 1, wherein the first inner diameter of the production tubular metal structure is equal to the second inner diameter of the tubular part of the liquid unloading assembly.

9. A downhole system according to claim 1, wherein the sliding sleeve is arranged in a recess of the tubular part.

10. A downhole system according to claim 1, wherein the sliding sleeve has a third inner diameter which is equal to the first inner diameter of the production tubular metal structure.

11. A downhole system according to claim 1, further comprising a liner hanger casing and a second production packer, the liner hanger casing being arranged between the first production packer and the second production packer, and the second production packer being arranged between the liner hanger casing and the production tubular metal structure.

12. A downhole system according to claim 11, wherein at least some of the check valve assemblies are arranged below the first production packer.

13. A downhole system according to claim 1, further comprising a tool with a detection unit configured to detect the presence of gas in the production tubular metal structure.

14. A liquid unloading method for unloading liquid of a well in an annulus between an intermediate casing and a production tubular metal structure, comprising:

pressurising the annulus with gas to displace the liquid from the top of the well in through the check valves in the downhole system according to claim 1, letting gas through the first check valve into the production tubular metal structure, detecting gas in the production tubular metal structure, closing the first check valve by means of the tool, displacing the liquid by letting the liquid in through the second check valve, letting gas through the second check valve into the production tubular metal structure, and detecting a gas in the production tubular metal structure.

15. A liquid unloading method according to claim 14, wherein detecting a gas is performed at the top of the well or by means of the tool.

16. A liquid unloading method according to claim 14, further comprising closing the second check valve.

17. A liquid unloading method according to claim 14, further comprising producing hydrocarbon-containing fluid.

* * * * *